US008082710B2

(12) United States Patent
Sigurdson et al.

(10) Patent No.: US 8,082,710 B2
(45) Date of Patent: Dec. 27, 2011

(54) REMOVABLE ATTACHMENT SYSTEM FOR BUILDINGS

(75) Inventors: James E. Sigurdson, Toronto (CA); John T. Sutton, Toronto (CA)

(73) Assignee: Ballistics Technology International Ltd., Wilmington, DE (US)

( * ) Notice: Subject to any disclaimer, the term of this patent is extended or adjusted under 35 U.S.C. 154(b) by 216 days.

(21) Appl. No.: 12/461,737

(22) Filed: Aug. 21, 2009

(65) Prior Publication Data

US 2011/0041436 A1 Feb. 24, 2011

(51) Int. Cl.
*E04B 1/41* (2006.01)
*E04B 1/38* (2006.01)

(52) U.S. Cl. ..... 52/285.1; 52/263; 52/236.6; 52/568; 52/253

(58) Field of Classification Search ..... 52/258–264, 52/266–267, 270, 272, 236.6, 236.9, 284, 52/285.2, 250–253, 581, 561–562, 566, 568–569
See application file for complete search history.

(56) References Cited

U.S. PATENT DOCUMENTS 2,741,908 A * 4/1956 Swanson ..... 52/274
4,087,944 A 5/1978 Mecklenburg
4,147,009 A * 4/1979 Watry ..... 52/742.15
4,583,336 A * 4/1986 Shelangoskie et al. ..... 52/250
4,703,602 A * 11/1987 Pardo ..... 52/564
5,669,194 A * 9/1997 Colasanto et al. ..... 52/236.8
5,761,863 A 6/1998 Sutt, Jr. et al.
5,950,390 A * 9/1999 Jones ..... 52/602
6,438,923 B2 * 8/2002 Miller ..... 52/745.19
6,802,160 B2 * 10/2004 Harambasic et al. ..... 52/264
6,915,614 B2 * 7/2005 Matsufuji ..... 52/600
7,185,467 B2 * 3/2007 Marty ..... 52/425
7,451,577 B2 11/2008 Little, Jr.
7,644,549 B2 * 1/2010 Speck ..... 52/235
2006/0016139 A1 * 1/2006 Beck et al. ..... 52/289
2006/0236627 A1 * 10/2006 Messenger ..... 52/272

* cited by examiner

*Primary Examiner* — Brian Glessner
*Assistant Examiner* — Beth Stephan
(74) *Attorney, Agent, or Firm* — Lynn C. Schumacher; Hill & Schumacher

(57) ABSTRACT

The present invention discloses an attachment system for use in a building comprising a plurality of first wall sections, a plurality of horizontal planks resting on the first wall sections, and a plurality of second wall sections resting on the horizontal planks. The system includes a plurality of threaded rods holding the system together, and may be made of concrete or similar material. The system may be disassembled and reassembled without affecting the structural integrity of the building.

23 Claims, 6 Drawing Sheets

REMOVABLE ATTACHMENT SYSTEM FOR BUILDINGS

FIELD OF THE INVENTION

The present invention relates to a modular attachment system, and more particularly the present invention relates to an attachment system that allows modular attachment and detachment of wall and plank members within a building.

BACKGROUND OF THE INVENTION

For buildings and other similar structures that face tremendous stress and damage, there is a need to provide constant maintenance and repair. Further, there is a need to construct buildings that may be assembled and then disassembled for relocation or maintenance. Some existing attachment systems are proved by U.S. Pat. Nos. 7,451,577, 5,761,863, and 4087944. Presently, known buildings and attachment systems to not provide for a means of efficiently constructing and deconstructing a building for relocation or repair while maintaining structural strength. Accordingly, a modular, stable, and efficient solution is highly desired in the art.

SUMMARY OF INVENTION

The present invention allows for the disassembly of components, including those at the interface between the floor and the wall on second and subsequent stories. In one embodiment of the invention, there is provided an attachment system comprising a plurality of first wall sections, a plurality of substantially horizontal planks, and a plurality of rods. The first wall sections may be vertical concrete members that interlock with one another to form a continuous concrete wall. The plurality of substantially horizontal planks may be made of concrete and interlock with one another to form a continuous concrete floor or roof. Each horizontal plank has at least one hole formed therein to allow a rod to pass therethrough. The at least one hole may be a tube cast into each horizontal plank. Each rod may be removably fastened to one of the first wall sections in a rod receiving portion such that the rod passes through the horizontal plank. A sealing washer, filler, and a second sealing washer and nut may be added to the hole in the horizontal plank for stability and rigidity.

The rod receiving portion in the first wall section may comprise a top plate and a mesh extending from the top plate and embedded in the first wall section. The top plate may include a nut into which the rod may removably be fastened. On a top surface of the top plate may be placed a steel member having at least two holes formed therein, with a rod passing through each of said holes in the steel member, such that the plurality of first wall sections may be more tightly fastened to one another.

In another aspect of the present invention, one may further include a plurality of second wall sections resting on the plurality of substantially horizontal planks. Each of the second wall sections includes a rod receiving portion, which may be a cavity in which the rod may pass through. The second wall sections may be vertical concrete members that interlock with one another to form a continuous concrete wall. The present invention may include additional horizontal plank sections and vertical wall sections thereby forming a structure having one or more floors.

In a preferred embodiment the concrete is designed to absorb bullets such that the structures may be mock-up houses used for live-fire training of military personal in clearing houses in urban settings.

Further, it may be advantageous to construct the system of the present invention of a material that can absorb bullets for use in training facilities.

BRIEF DESCRIPTION OF DRAWINGS

The following is a description, by way of example only, of the attachment system constructed in accordance with the present invention, reference being had to the accompanying drawings, in which.

DETAILED DESCRIPTION OF THE INVENTION

Generally speaking, the systems described herein are directed to an attachment system for buildings. As required, embodiments of the present invention are disclosed herein. However, the disclosed embodiments are merely exemplary, and it should be understood that the invention may be embodied in many various and alternative forms.

The figures are not to scale and some features may be exaggerated or minimized to show details of particular elements while related elements may have been eliminated to prevent obscuring novel aspects. Therefore, specific structural and functional details disclosed herein are not to be interpreted as limiting but merely as a basis for the claims and as a representative basis for teaching one skilled in the art to variously employ the present invention. For purposes of teaching and not limitation, the illustrated embodiments are directed to an attachment systems for buildings.

Figure 1:
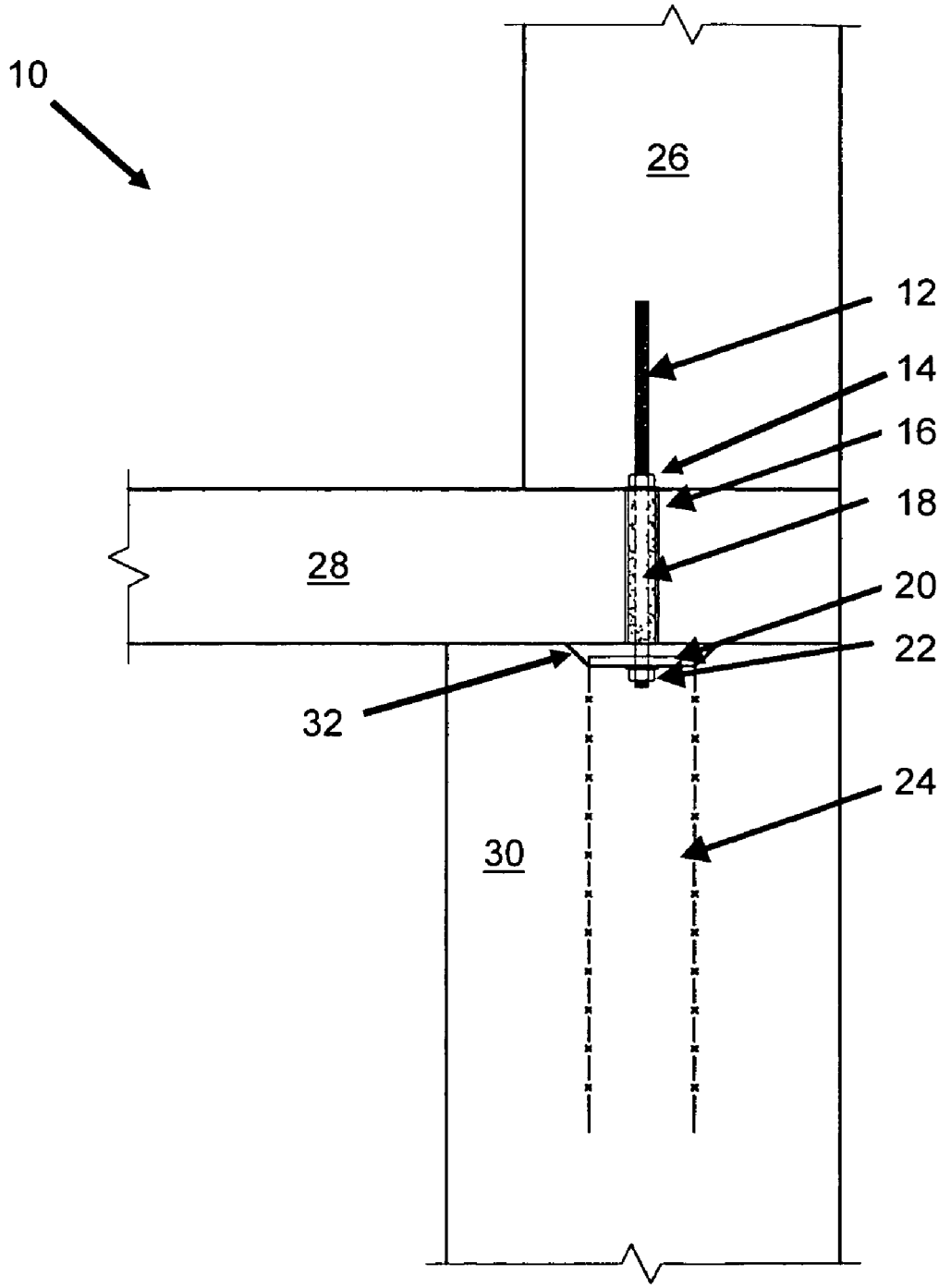
FIG. 1 shows a side cross-section of the attachment system for one section.
Figure 2:
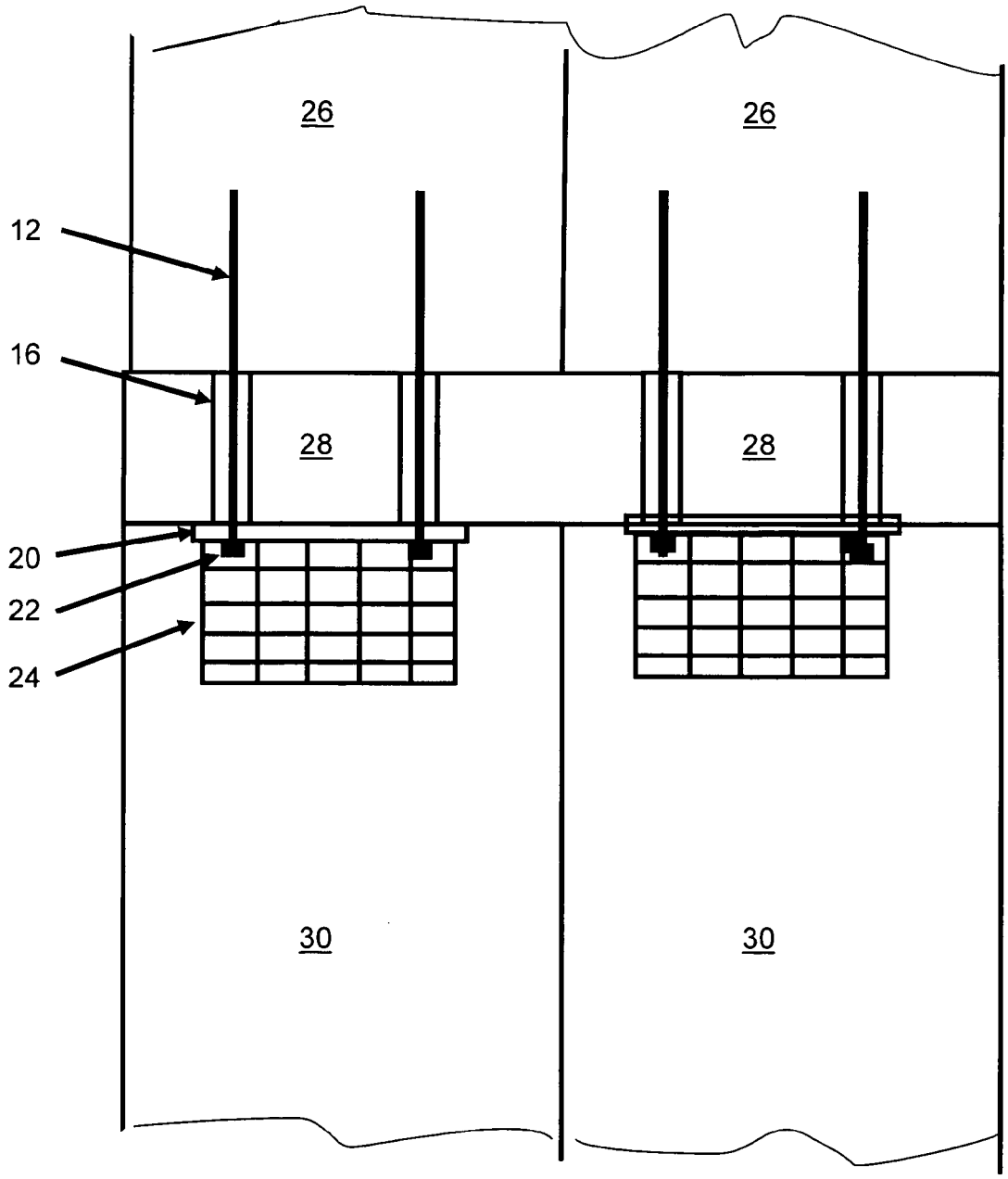
FIG. 2 shows a front cross-section of the attachment system for two sections.

Referring to FIG. 1 and FIG. 2, an attachment system shown generally at 10 includes a first wall section 30, a substantially horizontal plank section 28, and a second wall section 26 resting on the plank 28. The attachment system 10 involves the joining of modular wall sections 26 and 30 and horizontal plank sections 28 in such a manner that the structure 10 can be disassembled and reassembled without changing the structural integrity of surrounding members. In a preferred embodiment of the present invention, plank sections 28 can serve as floor members or roof members.

The removable attachment system 10 involves the attachment of a threaded rod 12 into the first wall section 30 by inserting it into a rod receiving portion, which may be a nut 22 welded to a top plate 20 embedded in the wall section 30. The top plate 20 is supported in the wall section 30 by a mesh cage 24 integrally formed therein to provide structural attachment to the first wall section 30.

Figure 3:
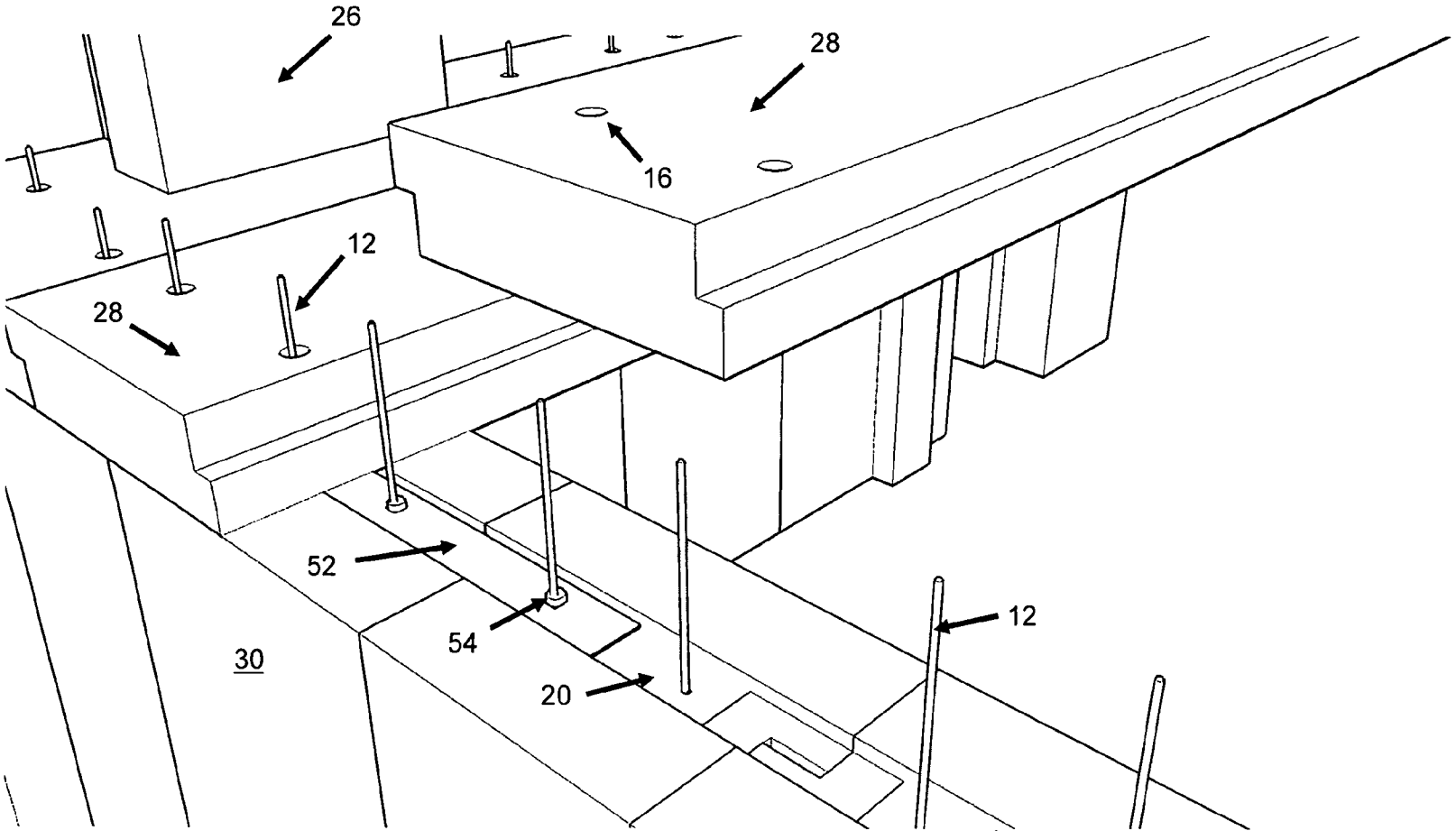
FIG. 3 shows a perspective view of the interlocking between horizontal plank sections.

As shown in FIG. 3, the first wall section 30 may require a cavity 32 at the top of the first wall section 30 in order that a steel member 52 be employed to tie the top of one or more first wall sections 30 together. A steel member 52 with holes may be placed in the cavity 32 running along the top of the first wall sections 30 and a nut and washer 54 installed on the threaded rod 12 will fasten the steel member 52 down to provide additional structural support to the first wall sections 30.

The horizontal plank section 28 is fabricated with a hole in it, which may be a pipe 16 cast into the plank 28 in such a manner that when the plank 28 is placed on top of a first wall section 30, the pipe 16 will allow the threaded rod 12 to pass vertically through the pipe 16. Several threaded rods 12 may be installed in the first wall section 30; the rods 12 are preferably sized such that they extend a sufficient distance above the horizontal plank 28 to provide the required structural support to the second wall section 26. Accordingly, second wall section 26 has a rod receiving portion included therein (not shown) which may be one or more hollow cavities which line up with the rods 12.

Referring to FIG. 1, once the horizontal plank 28 is in place, a sealing washer (not shown) may be placed over the threaded rod 12, and pushed down into the bottom of the tube 16, thus creating a seal in the bottom of the tube 16; a filler 18 is then poured into the tubes and leveled to a top surface of the horizontal plank 28. Non-limiting examples of filler 18 include lightweight concrete and concrete grout. Once the filler 18 has set, a nut and washer 14 may be employed to hold the plank section 28 securely to the first wall section 30.

Figure 5:
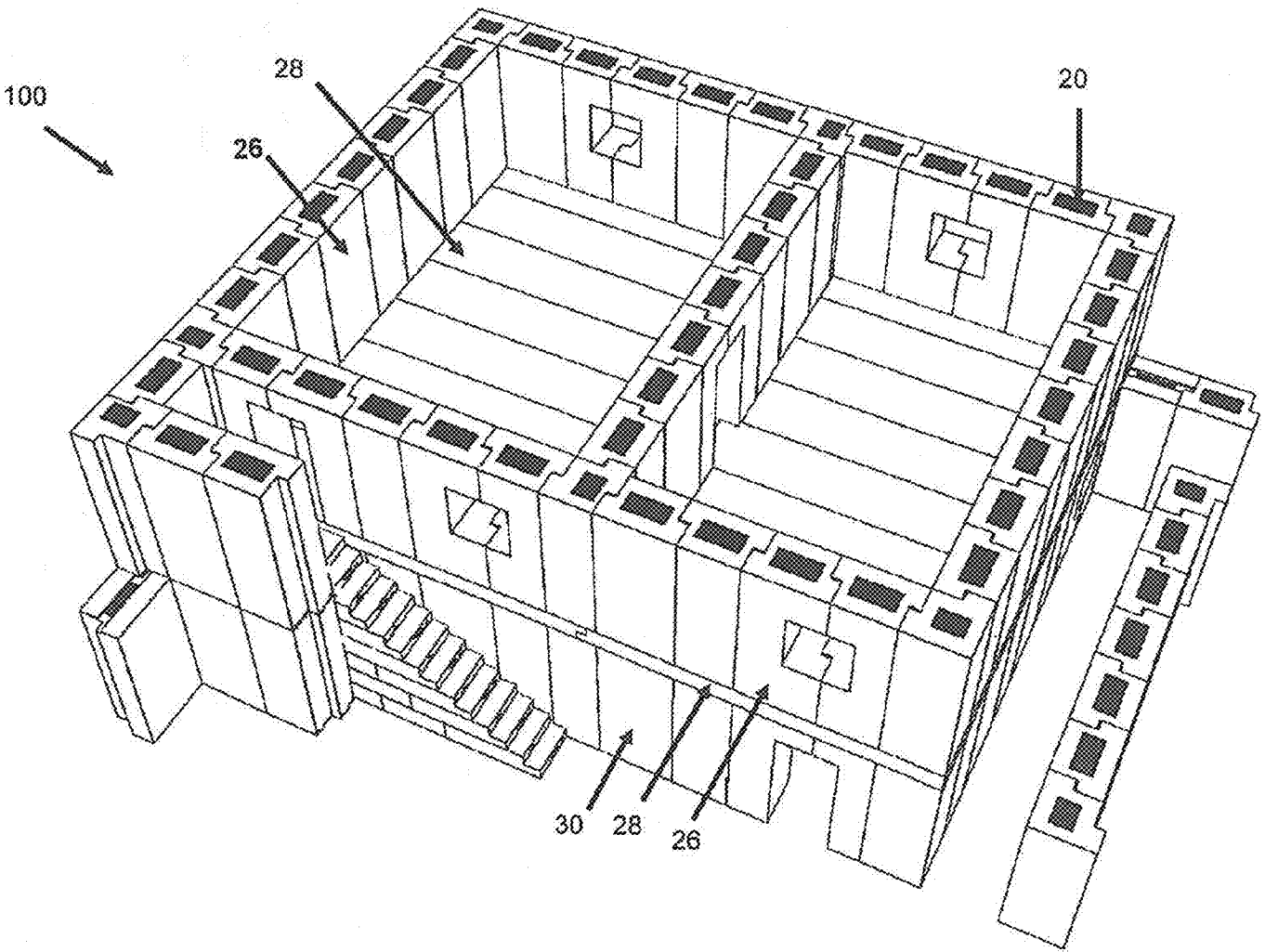
FIG. 5 shows a perspective view of a plurality of attachment systems forming a single structure.

As shown in FIG. 5, the attachment system 10 may be used to construct an entire building 100. In this configuration, the building may be relocated owing to its constituent modular attachment systems 10.

Figure 4:
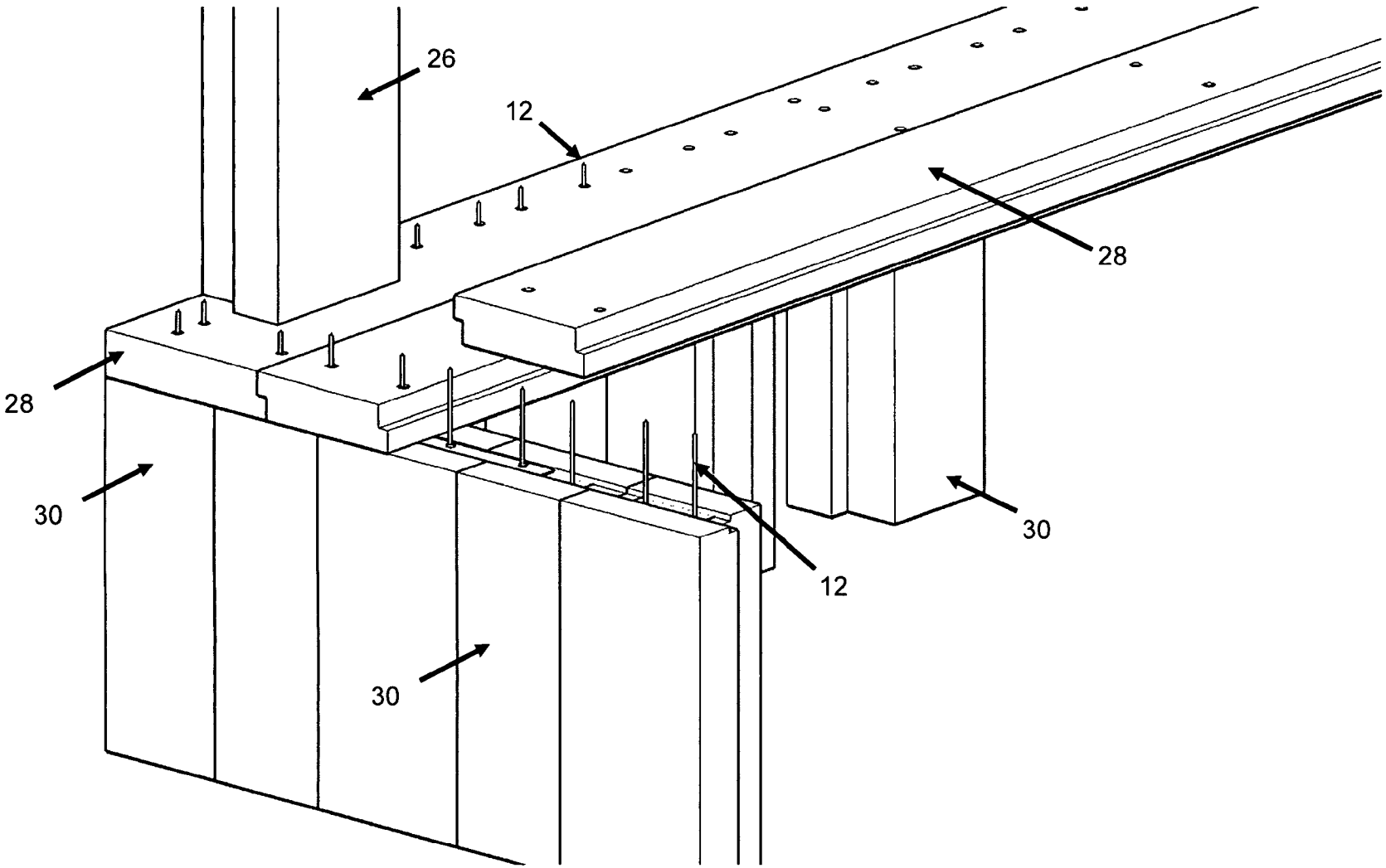
FIG. 4 is an alternate view of FIG. 3 showing a second wall section.

When it is required to disassemble or relocate the structure 10, the second wall section 26 is lifted off the vertical threaded rods 12; the nut and washer 14 holding the horizontal plank section 28 in place is removed; the filler 18 is removed from the pipe 16; and the rod 12 is removed from the first wall section 30. To re-assemble the system 10, the preceding steps are followed in reverse, as would be appreciated by a worker skilled in the art. Partial construction is best seen in FIG. 3 and FIG. 4

When disassembling and reassembling, the structural integrity of the system 10 in an over-all building's structural condition has not been changed. The number of first wall sections 30, the number of plank sections 28, and the number of second wall sections to be used is determined by the structural requirement of the over-all building.

As would be appreciated by those skilled in the art, second wall sections 26 are not necessary in which case horizontal plank sections 28 function as roof members. Further, this attachment system 10 may be used for a building with more than one floor, though there are structural limitations as the number of floors increases.

In a preferred embodiment of the present invention, the horizontal sections 28, first wall sections 30, and second wall sections 26 are made of concrete. The structure may be made of a bullet-absorbing concrete for use in training facilities, such as the concrete described in U.S. Pat. No. 6,264,735 which is incorporated herein by reference in their entirety. In this context bullet-absorbing concrete refers to concrete specifically designed to absorb projectiles with high kinetic energy such as those fired by weapons. It is highly advantageous to have a modular, reloadable, and reparable building for use in military applications. The ability to remove portions of a structure in order to replace areas worn by bullet impact and then re-assemble the building is highly valued.

Figure 6:
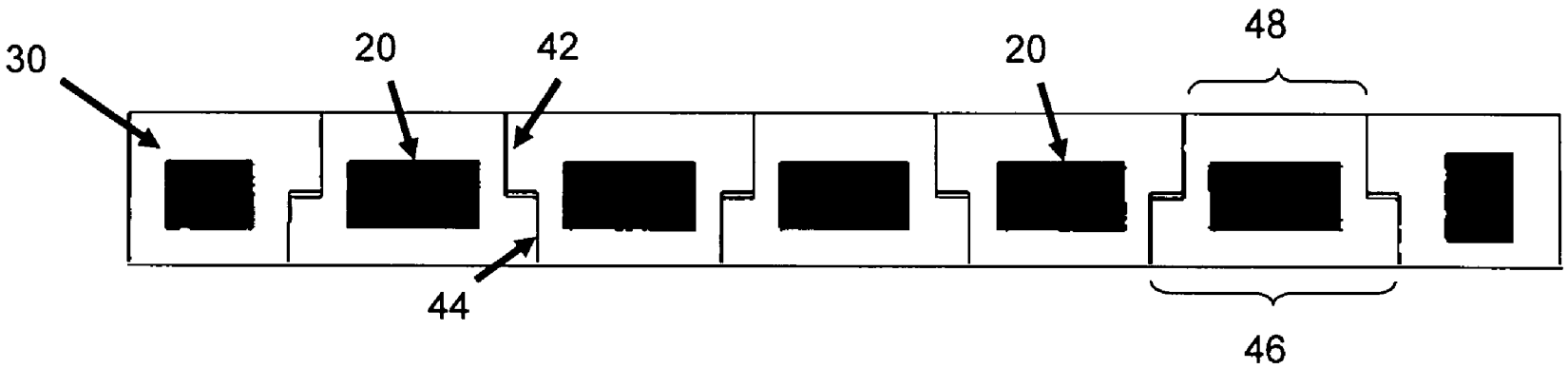
FIG. 6 shows the interlocking system between first wall sections.

As shown in FIG. 6, a preferred embodiment of the present invention includes interlocking edges. First wall sections 30 have edges 42 and 44 offset from one another that allow two different first wall sections 30 to form a more stable structure when combined. As shown in FIG. 3, both the horizontal plank sections 28 and the second wall sections 26 may have interlocking edges. Any shape of edge may be used provided that it matches with neighboring edges. In a preferred embodiment, the edges of the first wall sections have an thicker portion 46 and a thinner portion 48 as shown in FIG. 4, the two portions being offset from one another. The interlocking edges between the horizontal plank sections 28 are shown in FIG. 5 and may have two portions of substantially the same thickness offset from one another.

Those skilled in the art would appreciate that other arrangements of the attachment system may be employed. For example, it is not necessary that an entire building or every story use the modular system 10 provided by the present invention. For example, a second floor of FIG. 5 may be made of wooden planks tied down with threaded rods. Further, each rod 12 may be entirely or partially threaded.

As used herein, the terms "comprises", "comprising", "including" and "includes" are to be construed as being inclusive and open ended, and not exclusive. Specifically, when used in this specification including claims, the terms "comprises", "comprising", "including" and "includes" and variations thereof mean the specified features, steps or components are included. These terms are not to be interpreted to exclude the presence of other features, steps or components.

The foregoing description of the preferred embodiments of the invention has been presented to illustrate the principles of the invention and not to limit the invention to the particular embodiment illustrated. It is intended that the scope of the invention be defined by all of the embodiments encompassed within the following claims and their equivalents.

Therefore what is claimed is:

1. An attachment system for use in a building, the attachment system comprising:

a plurality of first wall sections, each having at least one first rod receiving portion;

a plurality of substantially horizontal planks, each having at least one hole formed therein, each of said plurality of planks resting on a top surface of the plurality of first wall sections;

a plurality of rods, each passing through the at least one hole in the plank and removably fastened to the first rod receiving portion; and each first wall section including a mesh insert attached to a top plate, said top plate having a hole, whereby said mesh insert and top plate are embedded in said first wall section so that said top plate and said hole is the first rod receiving portion.

2. The attachment system of claim 1, wherein each rod is threaded, and wherein said top plate has a threaded hole for removably fastening said threaded rod to said top plate.

3. The attachment system of claim 1, wherein a top surface of the plurality of first wall sections has a cavity formed therein, wherein the attachment system further comprises at least one steel member having at least two holes therein placed in said cavity, wherein at least one of the plurality of rods passes through the hole in the at least one steel member, and wherein the attachment system further comprises a nut fastened to the rod passing through the at least two holes in the at least one steel member.

4. The attachment system of claim 1 wherein each rod is threaded, and wherein said top plate has a threaded nut welded thereto for receiving said threaded rod for removably fastening said threaded rod to said top plate.

5. The attachment system of claim 4 wherein the plurality of first wall sections and the plurality of substantially horizontal planks are made of bullet-absorbing concrete.

6. The attachment system of claim 4 wherein the plurality of first wall sections and the plurality of substantially horizontal planks are made of concrete.

7. The attachment system of claim 1, further comprising a plurality of second wall sections, each having at least one second rod receiving portion, and each resting on a top surface of the plurality of substantially horizontal planks, and wherein each of said plurality of rods passes through the second rod receiving portion and the at least one hole in the plank.

8. The attachment system of claim 5, further comprising a plurality of second wall sections, each having at least one second rod receiving portion, and each resting on a top surface of the plurality of substantially horizontal planks, and wherein each of said plurality of rods passes through the second rod receiving portion and the at least one hole in the plank.

9. The attachment system of claim 1 wherein the plurality of first wall sections, the plurality of substantially horizontal planks, and the plurality of rods are removable from one another.

10. The attachment system of claim 7 wherein the plurality of first wall sections, the plurality of second wall sections, the plurality of substantially horizontal planks, and the plurality of rods are removable from one another.

11. The attachment system of claim 10 wherein each of the at least one hole in the plurality of substantially horizontal planks has a tube contained therein, wherein the attachment system further comprises at least one washer, each washer passing through one of the plurality of rods, and wherein said tube is filled with a filler.

12. The attachment system of claim 11 wherein the filler is one of:

lightweight concrete and concrete grout; wherein the plurality of rods are threaded; and wherein each rod further includes a second washer and a second nut fastened onto the rod above a top surface of the plurality of substantially horizontal planks.

13. The attachment system of claim 1 wherein the plurality of first wall sections have interlocking edges.

14. The attachment system of claim 8 wherein the plurality of first wall sections and the plurality of second wall sections have interlocking edges.

15. The attachment system of claim 13 wherein the plurality of substantially horizontal planks have interlocking edges.

16. The attachment system of claim 15 wherein the interlocking edges comprise a first portion and a second portion, the first portion being offset from the second portion such that the first portion of a first interlocking edge is in contact with the second portion of a second interlocking edge.

17. An attachment system for use in a building, the attachment system comprising:

a plurality of first concrete wall sections, each having at least one first rod receiving portion;

each first concrete wall section including a mesh insert attached to a top plate, said top plate having a hole, whereby said mesh insert and top plate are embedded in said first concrete wall section so that said hole is the first rod receiving portion;

a plurality of substantially horizontal concrete planks, each having at least one hole formed therein, each of said plurality of planks resting on a top surface of the plurality of first concrete wall sections;

a plurality of second concrete wall sections, each having at least one second rod receiving portion, and each resting on a top surface of the plurality of substantially horizontal planks; and a plurality of rods, each passing through the second rod receiving portion and the at least one hole in the plank, and each removably fastened to the first rod receiving portion.

18. The attachment system of claim 17 wherein the plurality of rods are threaded, wherein a top surface of the plurality of first concrete wall sections has a cavity formed therein, wherein the attachment system further comprises at least one steel member having at least two holes therein placed in said cavity, wherein at least one of the plurality of rods passes through the hole in the at least one steel member, and wherein the attachment system further comprises a nut fastened to said rod passing through the at least two holes in the at least one steel member such that the steel member is fastened to a top surface of the plurality of first concrete wall sections.

19. The attachment system of claim 18 wherein the plurality of substantially horizontal concrete planks, the plurality of first concrete wall sections, and the plurality of second concrete wall sections have interlocking edges, the interlocking edges comprising a first portion and a second portion, the first portion being offset from the second portion such that the first portion of a first interlocking edge is in contact with the second portion of a second interlocking edge.

20. The attachment system of claim 19 wherein each of the at least one hole in the plurality of substantially horizontal concrete planks has a tube contained therein, wherein the attachment system further comprises plurality of washers passing through the plurality of rods, and wherein said tube is filled with one of: lightweight concrete and concrete grout; and wherein each rod further includes a second washer and a second nut fastened onto the rod above a top surface of the plurality of substantially horizontal planks.

21. The attachment system of claim 1 wherein said mesh insert and said top plate are embedded in said first wall section so that a portion of said top plate forms a visible surface.

22. The attachment system of claim 18 wherein said top plate has a threaded hole for removably fastening said threaded rod to said top plate.

23. The attachment system of claim 18 wherein said top plate has a threaded nut welded thereto for receiving said threaded rod for removably fastening said threaded rod to said top plate.

* * * * *